US008601887B2

(12) United States Patent
Hirai et al.

(10) Patent No.: US 8,601,887 B2
(45) Date of Patent: Dec. 10, 2013

(54) STARTER WITH COMPACT STRUCTURE

(75) Inventors: Kensuke Hirai, Kariya (JP); Kazuhiro Andoh, Okazaki (JP); Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 503 days.

(21) Appl. No.: 12/314,002

(22) Filed: Dec. 2, 2008

(65) Prior Publication Data

US 2009/0145250 A1 Jun. 11, 2009

(30) Foreign Application Priority Data

Dec. 7, 2007 (JP) ..... 2007-317543

(51) Int. Cl.
*F02N 15/06* (2006.01)

(52) U.S. Cl.
USPC ..... 74/6

(58) Field of Classification Search
USPC ..... 74/6, 7 R, 7 A, 7 E; 277/317
See application file for complete search history.

(56) References Cited

U.S. PATENT DOCUMENTS

| | | | | |
|---|---|---|---|---|
| 4,104,926 | A * | 8/1978 | Wilson | 74/6 |
| 4,206,656 | A * | 6/1980 | Hollyoak | 74/6 |
| 4,958,530 | A * | 9/1990 | Jaseck et al. | 74/7 A |
| 5,054,329 | A | 10/1991 | Morishita et al. | |
| 5,101,114 | A | 3/1992 | Isozumi et al. | |
| 5,111,093 | A | 5/1992 | Tanaka | |
| 5,142,923 | A * | 9/1992 | McKnight et al. | 74/6 |
| 6,612,191 | B2 | 9/2003 | Imanishi et al. | |
| 6,813,967 | B2 | 11/2004 | Andou | |
| 2002/0066430 | A1 | 6/2002 | Kajino et al. | |
| 2004/0134294 | A1 | 7/2004 | Hirabayashi et al. | |

FOREIGN PATENT DOCUMENTS

| | | | |
|---|---|---|---|
| JP | U-50-045522 | | 5/1975 |
| JP | A-09-133066 | | 5/1997 |
| JP | A-10-037831 | | 2/1998 |
| JP | 11082251 | A * | 3/1999 |
| JP | A-11-82251 | | 3/1999 |
| JP | A-2002-180939 | | 6/2002 |
| JP | A-2006-207573 | | 8/2006 |

OTHER PUBLICATIONS

European Search Report mailed on Jun. 11, 2010 in corresponding European Patent Application No. 08 02 1091.7.
Notification of Reasons for Rejection, dated Jul. 5, 2011 in Japanese Patent Application No. 2007-317543 (with English translation).
Office Action dated Sep. 26, 2011 in counterpart Chinese Patent Application No. 200810182758.6.

* cited by examiner

*Primary Examiner* — Thomas B Will
*Assistant Examiner* — Abigail A Risic
(74) *Attorney, Agent, or Firm* — Oliff & Berridge, PLC

(57) ABSTRACT

A starter is disclosed as having a housing carrying thereon a motor, and a pinion moving body including a pinion gear, operative to mesh with a ring gear of an engine to transfer a rotational force of the motor thereto, and a pinion shielding member connected to the pinion gear at a front end thereof. The pinion shielding member has an outer circular periphery, having an outer diameter greater than the diameter of the addendum circle of the pinion gear, and a bottomed cylindrical configuration formed with a hollow portion having a front opened end and a closed rear end. Further, a clearance between an inner circumferential periphery of the nose portion and the outer circular periphery of the pinion shielding member is minimized to avoid interference between the nose portion of the housing and the pinion shielding member.

5 Claims, 4 Drawing Sheets

STARTER WITH COMPACT STRUCTURE

CROSS REFERENCE TO RELATED APPLICATIONS

This application is based on Japanese Patent Application No. 2007-317543, filed on Dec. 7, 2007, the content of which is hereby incorporated by reference.

BACKGROUND OF THE INVENTION

1. Technical Field of the Invention

The present invention relates to starters and, more particularly, to a starter the type in which a minion moving body, held in helical spline engagement with an output shaft at an outer circumferential periphery thereof, which is pushed toward an engine (in a direction opposite to a motor) to cause a pinion gear to be brought into meshing engagement with a ring gear.

2. Description of the Related Art

In the related art, there has been known a starter, which is disclosed in Japanese Patent Application Publication No. 2006-207573 (Patent Publication 1).

With such a structure shown in FIG. 4, the starter device is of the type including a housing 100 having a nose portion 101 protruding toward an engine and internally formed with an opening portion 102, and a motor 110 fixedly mounted on the housing 100. The motor 110 has an armature 111 provided with an armature shaft 111*a*, to which an output shaft 150 is connected via a speed reduction gear unit 120 and a clutch 130. The output shaft 150 has one axial end, placed in opposition to the motor 110, which is rotatably supported with the nose portion 101 at a distal end thereof via a bearing 140. The output shaft 150 has an outer circumferential periphery formed with a spline 102, to which a spline tube 160 is held in spline coupling engagement. The spline tube 160 has one axial end integrally formed with a pinion gear 170. When an electromagnetic switch 180 is energized, a shift lever 190 is drivably actuated to push the spline tube 160 toward the engine (rightward as viewed in FIG. 4). This causes the pinion gear 170 to be brought into meshing engagement with the ring gear 200 of the engine.

With the starter of such a related art, no issue occurs in normal use. However, under a situation where a vehicle runs on, for instance, a punishing road with the starter being used under an extremely adverse condition, there occurs a risk in which foreign materials such as grit and dust or water droplets, etc., collected by the ring gear 200 intrude inside of the starter through the opening portion 102 of the housing 100. Moisture, containing grit and dust or the like, causes defective sliding engagements to occur when intruded into sliding sections such as the speed reduction gear unit 12 and the clutch 130, etc.

With the starter of such a related art described above, however, no expedient measure has been undertaken for suppressing the intrusion of grit and dust or water droplets with a concern for degraded performance and defective operation of the starter resulting from defective sliding engagements of as the speed reduction gear unit 12 and the clutch 130 or rusting results of internal component parts.

SUMMARY OF THE INVENTION

The present invention has been completed with a view to addressing the above issues and has an object to provide a starter that can suppress grit and dust or water droplets from intruding from an opening portion of a nose portion to an inside of a housing to prevent the occurrence of degraded performance and defective operation of the starter.

To achieve the above object, the present invention provides a starter comprising a housing having an engine mounting surface adapted to rest on an engine having a ring gear, and a nose portion extending from the engine mounting portion toward the engine and having an opening portion, a motor fixedly mounted on the housing and having an armature generating a rotational force and an armature shaft on which the armature is supported, an output shaft disposed in a coaxial relationship with the armature shaft and having axial ends one end of which is rotatably supported with the nose portion by means of a bearing at a position opposite to the motor, and a pinion moving body having a pinion gear operative to mesh with the ring gear to transfer the rotational force to the ring gear and fitted on the output shaft at an outer periphery thereof in helical spline engagement. The pinion moving body comprises a pinion shielding member connected to the pinion gear at one end axially placed in opposition to the ring gear. The pinion shielding member has an outer circumferential periphery, having an outer diameter greater than a diameter of an addendum circle of the pinion gear, and a bottomed cylindrical configuration formed with a hollow portion having one axial end facing the ring gear and opened and the other axial end directed in opposition to the ring gear and closed.

With the starter of such a structure, the pinion shielding member has the outer circumferential periphery with the outer diameter greater than the diameter of the addendum circle of the pinion gear. Thus, the starter can have a clearance between an inner circumferential portion of the nose portion and the outer circumferential periphery of the pinion shielding member that is made less than a clearance between the inner circumferential portion of the nose portion and the diameter of the addendum circle of the pinion gear. In this case, the pinion shielding member has a function to serve as water proofing wall. This suppresses foreign materials such as grit and dust or water droplets, collected up by the ring gear, from intruding to the inside of the housing.

Further, the pinion shielding member has the hollow portion having one axial end facing the ring gear and opened and the other axial end directed in opposition to the ring gear and closed. Therefore, even if the water droplets, collected up by the ring gear, intrude from the opening portion of the nose portion into the hollow portion, the hollow portion can block the intrusion of the water droplets. Thus, no risk takes place for the water droplets intrude into a further inside area of the starter. In addition, a water flow, intruded from the opening portion of the nose portion, has a momentum that is weakened with the hollow portion, providing improved effect of preventing the intrusion of water.

With the starter of the present embodiment, the nose portion of the housing and the pinion shielding member may preferably have a relationship in that a clearance, defined between an inner circumferential periphery of the nose portion and the outer circumferential periphery of the pinion shielding member, is kept constant in an area starting from a stop position, in which the pinion disengages from the ring gear to be halted, to a meshing position in which the pinion meshes with the ring gear.

With such a structure, foreign materials or water droplets, etc., can be prevented from intruding to the inside of the housing regardless of positions (a stop position and a meshing position) in which the pinion gear is placed.

With the starter of the present embodiment, the pinion shielding member may preferably have a plurality of ribs radially extending between an inner periphery and an outer periphery of the hollow portion.

Providing the hollow portion provided with the plural ribs compensates for the drop in strength of the pinion shielding member caused by the formation of the hollow portion. Moreover, the hollow portion is divided with the ribs into a plurality of compartments, which can minimize the momentum of a water stream intruded into the hollow portion, thereby providing an increased effect of preventing water from intruding to the inside of the housing.

With the starter of the present embodiment, the pinion shielding member may be preferably made of resin separately from the pinion gear and assembled to the pinion gear by snap fitting with elasticity.

Providing the pinion shielding member independently of the pinion gear enables the pinion shielding member to be easily formed by resin molding, while enabling the pinion gear and the pinion shielding member to be easily assembled in a snap fitting fashion.

With the starter of the present embodiment, an electromagnetic switch may be further preferably provided to be operative to form an electromagnet providing an attraction force to drive a shift lever for moving the pinion moving body toward the ring gear of the engine, wherein the pinion shielding member is integrally formed with a lever engaging portion held in engagement with the shift lever.

With the pinion shielding member integrally formed with the lever engaging portion, the number of component parts can be reduced in the starter.

DETAILED DESCRIPTION OF PREFERRED EMBODIMENTS

Now, a starter of one embodiment according to the present invention will be described below in detail with reference to the accompanying drawings. However, the present invention is construed not to be limited to such an embodiment described below and technical concepts of the present invention may be implemented in combination with other known technologies or the other technology having functions equivalent to such known technologies.

In the following description, it is to be understood that such terms as "front", "rear", "axial", "outer", "inner", "radial", "outward", "rightward", "leftward", "circumferential", "distal", "end" and the like are words of convenience and are not to be construed as limiting terms.

Further, as used herein, the term "front" refers to a front portion of a component part at a position axially closer to an engine or a ring gear of the engine, i.e., an area oriented in a direction opposite to a motor incorporated in a starter to which the present invention is related. Likewise, the term "rear" refers to a rear portion of the component part closer to the motor incorporated in the starter, i.e., the other area oriented in a direction opposite to the engine.

The starter of an embodiment according to the present invention will be described below in detail with reference to the accompanying drawings.

Embodiment

Figure 1:
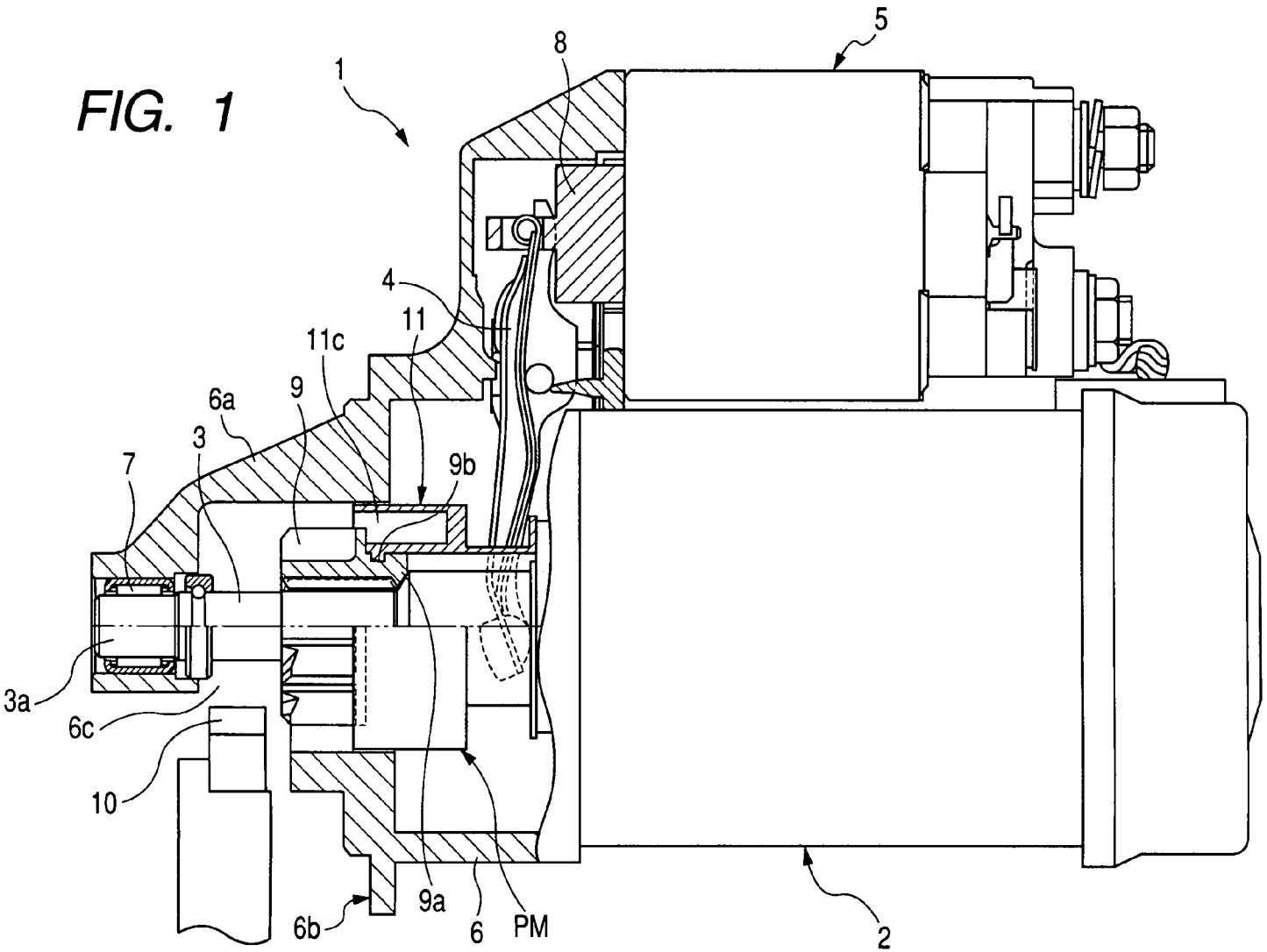
FIG. 1 is a cross sectional view showing an overall structure of a starter of an embodiment according to the present invention.

FIG. 1 is a cross sectional view showing the starter 1 of the present embodiment implementing the present invention.

As shown in FIG. 1, the starter 1 of the present embodiment includes a motor 2 having an armature (not shown) for generating a rotational force, an output shaft 3 to which the rotational force is transferred from the armature through a clutch (not shown), a pinion moving body PM (described later) located on the output shaft 3 at its outer circumferential periphery, an electromagnetic switch 5 having not only a function to open or close a main contact (not shown) disposed in an energization circuit (motor circuit) of the motor 2 but also a function to move the pinion moving body PM via a shift lever 4 in an axial direction, and a housing 6 to which the motor 2 and the electromagnetic switch 5 are fixedly mounted.

The motor 2 is a well-known DC electric motor operative such that with the main contact being closed upon energization of the electromagnetic switch 5, the DC electric motor is supplied with electric power from an on-vehicle battery (not shown) to cause the armature to generate the rotational force.

The clutch takes the form of a one-way clutch that is operative to transfer drive torque from the motor 2 to the output shaft 3 during a startup of an engine whereas when an engine rotation is transferred to the starter 1 due to the startup of the engine, a power transfer path between an input and an output (on a side of the output shaft) is disconnected to interrupt a transfer of torque for preventing the engine rotation from being transferred to the input (on the side of the motor) of the clutch.

Further, a speed reduction gear unit may be disposed between the motor 2 and the clutch. The speed reduction gear unit may preferably include a planetary gear type speed reduction gear device that can achieve a speed reduction on, for instance, the same axis as that of the armature shaft of the motor 2.

The output shaft 3, placed on the same axis as that of the armature shaft in a coaxial relation, has an axial front end 3*a*, axially placed in opposition to the motor 2 and rotatably supported with a bearing 7 mounted on a distal end of the housing 6 at a nose portion 6*a* thereof, and an axial rear end that is closer to the motor 2 and connected to the clutch.

The electromagnetic switch device 5 is comprised of an electromagnetic coil (not shown) operative to be energized with electric power delivered from the one-vehicle battery due to a starter switch (not shown) being closed in operation, and a plunger 8 disposed in the electromagnetic coil to be movable therethrough. With the electromagnetic coil being energized to form an electromagnet, the electromagnet attracts the plunger 8 to close the main contact in operation. In contrast, with the electromagnetic coil being de-energized to distinguish the attraction force of the electromagnet, the plunger 8 is pushed back to its original position by the action of a reactive force stored in a return spring (not shown) to open the main contact in operation.

The housing 6 has the nose portion 6*a* that protrudes from a mounting surface 6*b*, operative to rest on the engine, in a front direction (rightward as viewed in FIG. 1) opposite to the motor 2. The nose portion 6*a* is internally formed with an opening portion 6*c* to accommodate therein a pinion gear 9 and a ring gear 10 of the engine that are operative to be brought into meshing engagement with each other in a manner as described below in detail.

Next, an overall structure of the pinion moving body PM, implementing the present invention, will be described below in detail.

The pinion moving body PM is comprised of the pinion gear 9 and a pinion shielding member 11.

The pinion gear 9 is coupled to an outer circumferential periphery of the output shaft 3 in a helical spline engagement to be rotatable unitarily with the output shaft 3 to have a function to transfer the rotational force of the motor 2 to the ring gear 10. The pinion gear 9 is made of, for instance, iron, and has an axial rear end, placed in opposition to the ring gear 10, which is unitarily formed with a trunk portion 9*a* (see FIG. 1) having an outer circumferential periphery formed with an annular circumferential recess 9*b*.

Figure 2B:
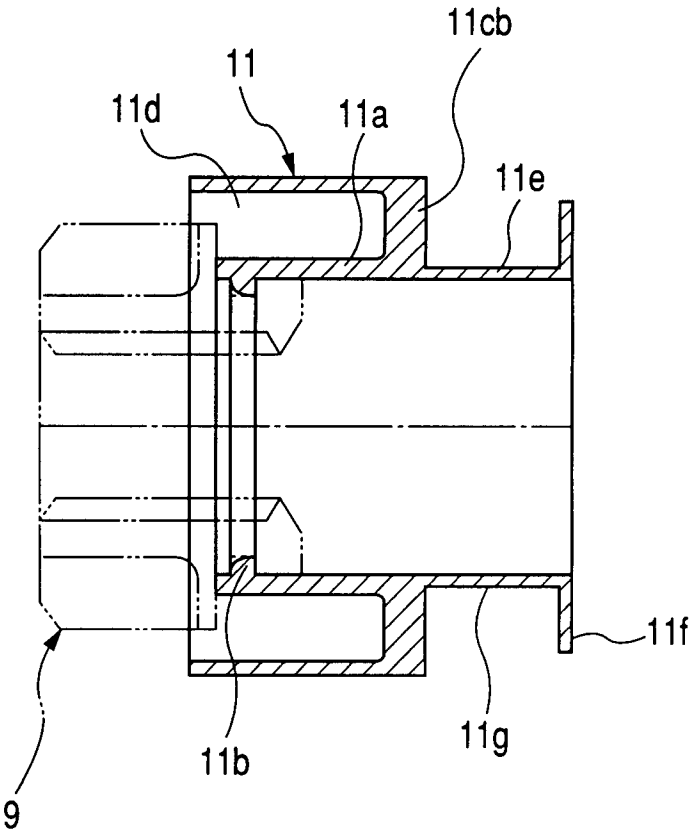
FIG. 2B is a cross sectional view of the pinion shielding member taken on line A-A of FIG. 2A.
Figure 2A:
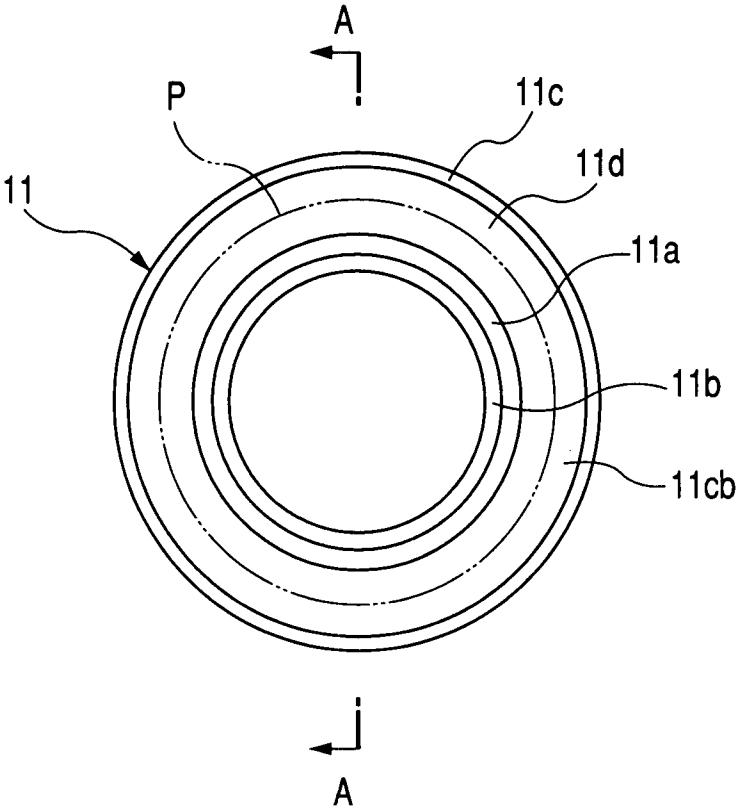
FIG. 2A is a plan view of a pinion shielding member, forming part of the starter shown in FIG. 1, as viewed in an axial direction.

The pinion shielding member 11, made of, for instance, resin separately from the pinion gear 9, is fitted to the trunk portion 9*a* of the pinion gear 9 in assembly by means of a snap fitting fashion utilizing elasticity to be rotatable relative to the pinion gear 9. That is, the pinion shielding member 11 has a cylindrical portion 11*a* which can be fitted to the trunk portion 9*a* of the pinion gear 9 as shown in FIGS. 2A and 2B. The cylindrical portion 11*a* has a front end axial internally formed with a radially inwardly protruding a ring-shaped claw portion 11*b*, which is fitted to the annular circumferential recess 9*b* formed on the trunk portion 9*a* of the pinion gear 9. This allows the cylindrical portion 11*a* to be easily assembled to the pinion gear 9.

The pinion shielding member 11 has an outer circumferential cylindrical portion 11*c* having an outer diameter larger than that of an addendum circle of the pinion gear 9. The outer circumferential cylindrical portion 11*c* is formed in a bottomed ring-shaped configuration, having a radially extending bottom wall 11*cb* connected to the cylindrical portion 11*a* at a rear end thereof, which is internally formed with an annular hollow portion 11*d* defined between the cylindrical portion 11*a* and the outer circumferential portion 11*c*. The annular hollow portion 11*d* has a front axial end that is opened and a rear end closed with the bottom wall 11*cb*. In addition, with the pinion shielding member 11 assembled to the pinion gear 9 in assembly, the annular hollow portion 11*d* of the pinion shielding member 11 is opened in an area radially outward of the diameter (indicated by a phantom line P in FIG. 2A) of the addendum circle of the pinion gear 9 as viewed the pinion shielding member 11 in an axial direction from the pinion gear 9 as shown in FIG. 2A.

With the pinion gear 9 disengaged from the ring gear 10 of the engine to stay under a halted condition (at a position shown in FIG. 1), there is a slight amount of clearance (in the order of, for instance, approximately 0.5 to 2.0 mm) between an inner peripheral surface of the opening portion 6*c* of the nose portion 6*a* and an outer circumferential periphery of the outer cylindrical portion 11*c* of the pinion shielding member 11. This clearance is set to be less than that created between the inner peripheral surface of the opening portion 6*c* of the nose portion 6*a* and the outer diametric periphery of the pinion gear 9 at the addendum circle thereof (see FIG. 1).

In other word, the clearance between the inner peripheral surface of the opening portion 6*c* of the nose portion 6*a* and the outer circumferential periphery of the outer cylindrical portion 11*c* of the pinion shielding member 11 is set to an extent as small as possible to ensure the pinion moving body PM is prevented from conflicting the inner circumferential periphery of the opening portion 6*c* of the nose portion 6*a* during movement of the pinion moving body PM in the axial direction.

Further, the clearance between the inner peripheral surface of the opening portion 6*c* of the nose portion 6*a* and the outer circumferential periphery of the outer cylindrical portion 11*c* of the pinion shielding member 11 is formed to have an approximately constant value in an area from a stop position of the pinion gear 9 to a meshing position at which the pinion gear 9 meshes with the ring gear 10. That is, between the stop position and the meshing position of the pinion gear 9, no remarkable variation takes place in the clearance between the outer circumferential periphery of the outer cylindrical portion 11*c* and the inner peripheral surface of the opening portion 6*c* of the nose portion 6*a*, which is kept nearly constant.

Furthermore, with the present embodiment, the pinion shielding member 11 has a barrel portion 11*e* formed integrally with a rear end of the cylindrical portion 11*a* at a position opposite to the pinion gear in a coaxial relationship. The barrel portion 11*e* has a rear end formed with an annular flange portion 11*f* with an annular recess 11*g* being defined between the bottom wall 11*cb* and the annular flange 11*f*. The annular recess 11*g* of the barrel portion 11*e* accommodates therein the shift lever 4.

Next, the operation of the starter 1 is described below.

As a starter switch is closed in operation, the electromagnetic coil is energized to form the electromagnet. Then, the electromagnet attracts the plunger 8 with the movement of the plunger 8 being transferred to the pinion shielding member 11 via the shift lever 4. This causes the pinion shielding member 11 to rotate on the output shaft 3 due to an action of the helical spline to be axially pushed toward the ring gear 10 of the engine (leftward as viewed in FIG. 1) such that the pinion gear 9 is brought into meshing engagement with the ring gear 10.

Meanwhile, the movement of the plunger 8 results in a consequence of closing the main contact of the motor circuit, thereby permitting the battery to apply the motor 2 with electric power to cause the armature to generate the rotational force. The rotation of the armature is transferred to the output shaft 3 via the clutch, causing the pinion gear 9 to rotate unitarily with the output shaft 3. When this takes place, drive torque of the motor 2 is transferred from the pinion gear 9 to the ring gear 10, thereby cranking up the engine.

When the engine is cranked up to perform complete combustion with the starter switch being opened, the electromagnetic coil is de-energized to diminish the electromagnet. This causes the plunger 8 to be pushed back to its original position due to the reactive force stored in the return spring. As a result, the main contact is opened and no electric power is supplied from the battery to the motor 2. Thus, the armature gradually decelerates to halt in operation.

Moreover, as the plunger 8 is pushed back, the shift lever 4 swings in a direction opposite to that in which the shift lever 4 swings during the startup of the engine. Thus, the pinion moving body PM is pushed back in a direction opposite to the engine (rightward as viewed in FIG. 1). This causes the pinion gear 9 to disengage from the ring gear 10, after which the pinion gear 9 is restored to a halt position shown in FIG. 1.

Advantageous Effect of the Present Embodiment

With the starter 1 of the present embodiment, the pinion shielding member 11, formed on the pinion moving body PM, has the outer circumferential periphery with an outer diameter greater than that of the addendum circle of the pinion gear 9. This enables the clearance between the inner peripheral surface of the opening portion 6*c* of the nose portion 6*a* and the outer circumferential periphery of the outer cylindrical portion 11*c* to be less than the clearance between the inner peripheral surface of the opening portion 6*c* of the nose portion 6*a* and the outer diameter of the addendum circle of the pinion gear 9. In this case, the pinion shielding member 11 has a function to serve as a water-proofing wall. This avoids foreign materials such as grit and dust or water droplets or the like collected by the ring gear 10 from intruding from the opening portion 6*c* of the nose portion 6*a* into the inside of the housing 6.

Further, the pinion shielding member 11 is formed with the annular hollow portion 11*d* having the front end being opened in the axial direction and the rear end closed with the radially extending bottom wall 11*cb*. Therefore, even if the water droplets, collected by the ring gear 10, intrude from the opening portion 6*c* of the nose portion 6*a* of the housing 6 into the annular hollow portion 11*d*, the annular hollow portion 11*d* blocks the entry of the water droplets. This blocks the water droplets from further intruding to the inside of the starter 1. In addition, the annular hollow portion 11*d* weakens the momentum of any water stream intruding from the opening portion 6*c* of the nose portion 6*a* of the housing 6, thereby improving an effect of preventing the water intrusion.

Furthermore, between the stop position and the meshing position of the pinion gear 9, the clearance between the inner peripheral surface of the opening portion 6*c* of the nose portion 6*a* and the outer circumferential periphery of the pinion shielding member 1 is kept approximately constant. This suppresses foreign materials and water droplets or the like from intruding into the inside of the housing 6 regardless of the positions (stop position and the meshing position) of the pinion gear 9.

Further, with the pinion gear 9 and the pinion moving body PM formed in a separate structure, the pinion shielding member 11 can be easily formed by resin-molding and the pinion gear 9 and the pinion shielding member 11 can be readily assembled to each other with snap fitting action.

Furthermore, with the pinion shielding member 11 formed by resin-molding, the barrel portion 11*e* can be easily formed integrally with the pinion shielding member 11 to engage with the shift lever 4, resulting in an effect of achieving a reduction in the number of component parts.

With the present embodiment, the pinion moving body PM is comprised of the pinion gear 9 and the pinion shielding member 11 formed in separate bodies and the pinion gear 9 is made of iron while the pinion shielding member 11 is made of resin with lower density than that of the pinion gear 9, enabling a reduction in mass of the pinion shielding member 11. This results in a reduction in weight of the pinion moving body PM. This decreases a force (attraction force of electromagnet) required for pushing the pinion moving body PM toward the engine via the shift lever 4, making it possible to form the electromagnetic switch 5 to be small in size.

Modified Form of Pinion Shielding Member

A pinion shielding member of a modified form is described below with reference to FIGS. 3A and 3B.

Figure 3B:
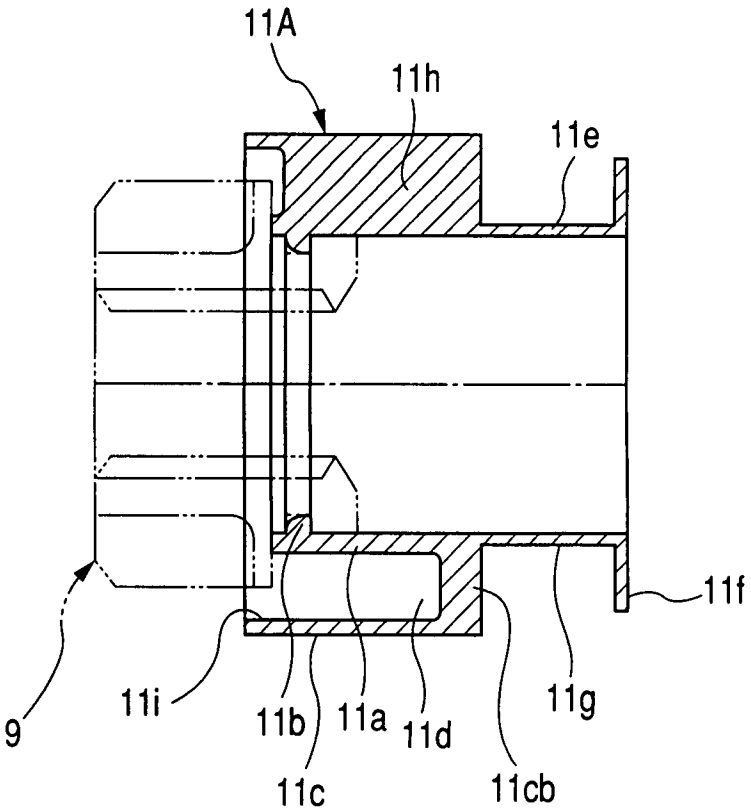
FIG. 3B is a cross sectional view of the pinion shielding member taken on line B-B of FIG. 3A.
Figure 3A:
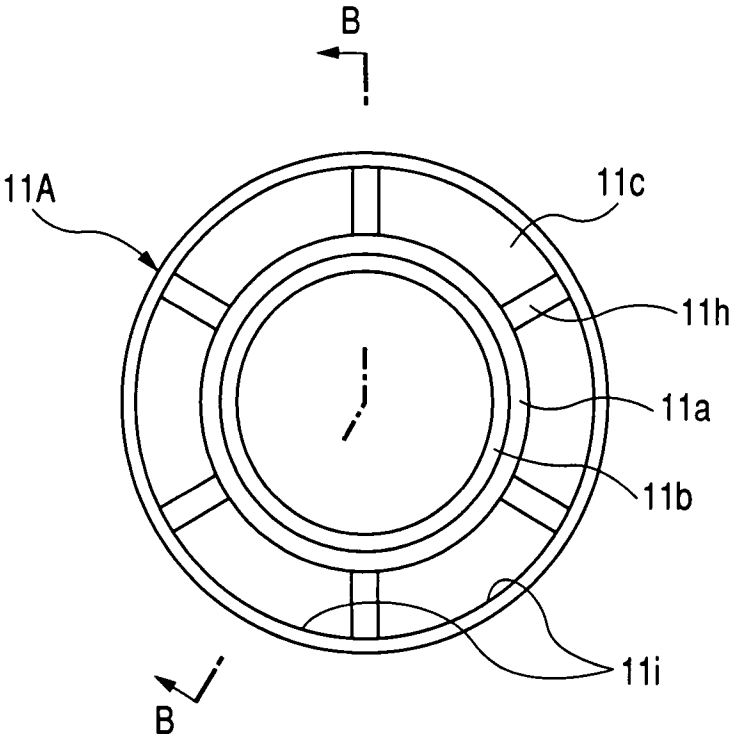
FIG. 3A is a plan view of a pinion shielding member of a modified form as viewed in an axial direction.
Figure 4:
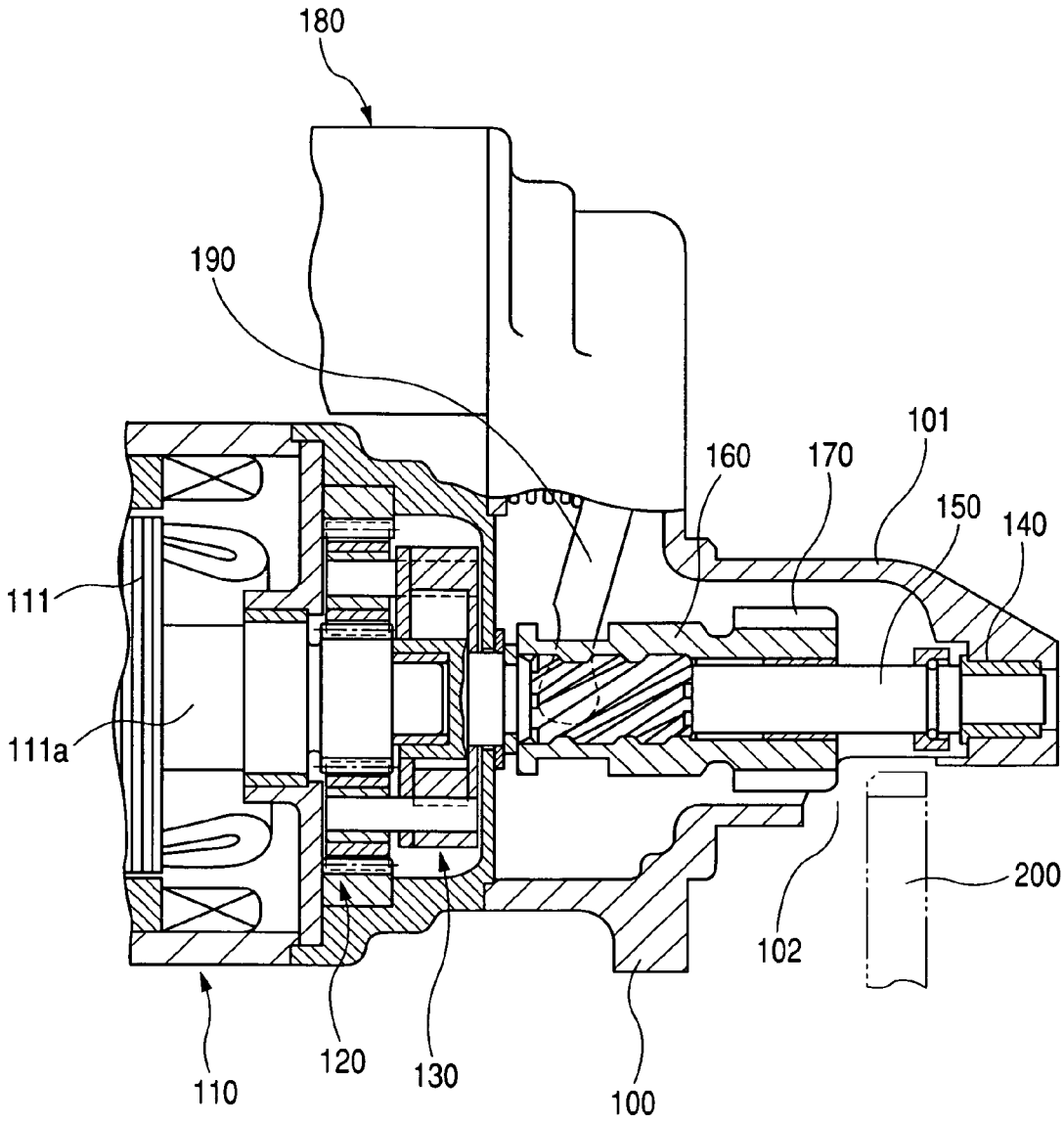
FIG. 4 (PRIOR ART)
FIG. 4 is a cross sectional view of a starter of the related art.

FIG. 3A shows a front view of the pinion shielding member 11A of the modified form and FIG. 3B is a cross sectional view of the pinion shielding member 11A of the modified form shown in FIG. 3A.

With the modified form shown in FIGS. 3A and 3B, the pinion shielding member 11A has a plurality of ribs 11*h* axially extending through the annular hollow portion 11*d* at circumferentially spaced positions and having rear ends formed integrally with the bottom wall 11*cb* of the pinion shielding member 11A. As shown in FIG. 3A, more particularly, the pinion shielding member 11A includes the cylindrical portion 11*a*, serving as an inner circumferential wall of the annular hollow portion 11*d*, and the outer cylindrical portion, serving as an outer circumferential wall of the annular hollow portion 11*d*, with the plurality of ribs 11*h* radially interconnecting the inner and outer circumferential walls of the inner and outer cylindrical portions 11*a* and 11*c*, respectively. The plurality of ribs 11*h* are placed at circumferentially equidistantly spaced intervals, thereby partitioning the annular hollow portion 11*d* into a plurality of small compartments 11*i*.

With the present embodiment of such a structure, the ribs 11*h* formed in the annular hollow portion 11*d* compensates for a drop in rigidity of the pinion shielding member 11A caused by the formation of the annular hollow portion 11*d*. In addition, the annular hollow portion 11*d* is divided into the plurality of small compartments 11*i* defined with the plurality of ribs 11*h*. This suppresses the momentum of the water stream intruding to the annular hollow portion 11*d*, thereby providing an increased effect of suppressing the intrusion of water to the inside of the housing 6.

While the starter 1 of the present embodiment has been described above with reference to a structure in which the pinion shielding member 11 and the pinion gear 9 are formed to be independent from one another, both of these component parts may be formed of the same material in a unitary structure. In such a case, the pinion shielding member 11 may be possibly formed by, for instance, cutting and forging or the like.

While the specific embodiment of the present invention has been described in detail, it will be appreciated by those skilled in the art that various modifications and alternatives to those details could be developed in light of the overall teachings of the disclosure. Accordingly, the particular arrangement disclosed is meant to be illustrative only and not limited to the scope of the present invention, which is to be given the full breadth of the following claims and all equivalents thereof.

What is claimed is:

1. A starter comprising:

a housing having an engine mounting surface adapted to rest on an engine having a ring gear, and a nose portion extending from the engine mounting surface toward the engine and having an opening portion;

a motor fixedly mounted on the housing and having an armature generating a rotational force and an armature shaft on which the armature is supported;

an output shaft disposed in a coaxial relationship with the armature shaft and having axial ends one end of which is rotatably supported with the nose portion by means of a bearing at a position opposite to the motor;

a pinion moving body having a pinion gear with a trunk portion the pinion gear being operative to mesh with the ring gear to transfer the rotational force to the ring gear and fitted on the output shaft at an outer periphery thereof in helical spline engagement; and an electromagnetic switch operative to form an electromagnet providing an attraction force to drive a shift lever for moving the pinion moving body toward the ring gear of the engine;

wherein the pinion moving body comprises a pinion shielding member that is made of resin, made separately from the pinion gear and directly connected to the pinion gear, at one end axially placed in opposition to the ring gear, so as to be rotatable relative to the pinion gear;

wherein the pinion shielding member has a cylindrical portion and an outer circumferential cylindrical portion, with the cylindrical portion directly connected to the trunk portion of the pinion gear;

wherein the outer circumferential periphery of the pinion shielding member has an outer diameter greater than a diameter of an addendum circle of the pinion gear, and a bottomed cylindrical configuration formed with a hollow portion having one axial end facing the ring gear and opened and the other axial end directed in opposition to the ring gear and closed;

wherein the outer circumferential cylindrical portion of the pinion shielding member axially extends, on a radially outer side of the cylindrical portion of the pinion shielding member, so as to define the outer circumferential periphery of the pinion shielding member and forms the hollow portion between the cylindrical portion and the outer circumferential cylindrical portion;

wherein the pinion shielding member is integrally formed with a lever engaging portion held in engagement with the shift lever so that, during rotation of the pinion gear, the pinion shielding member is prevented from rotating along with the pinion gear;

wherein only the pinion gear and the pinion shielding member are shifted by the shift lever; and wherein a clearance between an inner circumferential periphery of the nose portion of the housing and the outer circumferential periphery of the pinion shielding member is less than a clearance between the inner circumferential periphery of the nose portion of the housing and the addendum circle of the pinion gear.

2. The starter according to claim 1, wherein:

the nose portion of the housing and the pinion shielding member have a relationship in that the clearance between the inner circumferential periphery of the nose portion of the housing and the outer circumferential periphery of the pinion shielding member is kept constant in an area starting from a stop position, in which the pinion gear disengages from the ring gear to be halted, to a meshing position in which the pinion gear meshes with the ring gear.

3. The starter according to claim 1, wherein:

the pinion shielding member has a plurality of ribs radially extending between an inner periphery and an outer periphery of the hollow portion.

4. The starter according to claim 1, wherein:

the cylindrical portion of the pinion shielding member is directly connected to the trunk portion of the pinion gear by snap fitting with elasticity.

5. The starter according to claim 1, wherein:

the outer circumferential periphery of the pinion shielding member overlaps, at least partially, the pinion gear in a radial direction of the output shaft.

* * * * *